US006379521B1

(12) United States Patent
Nishio

(10) Patent No.: US 6,379,521 B1
(45) **Date of Patent: *Apr. 30, 2002**

(54) METHOD OF PRODUCING ZINC OXIDE FILM, METHOD OF PRODUCING PHOTOVOLTAIC ELEMENT, AND METHOD OF PRODUCING SEMICONDUCTOR ELEMENT SUBSTRATE

(75) Inventor: Yutaka Nishio, Kyotanabe (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/222,848

(22) Filed: Dec. 30, 1998

(30) Foreign Application Priority Data

Jan. 6, 1998 (JP) ..... 10-000750

(51) Int. Cl.[7] ..... C25D 21/06; C25D 9/00
(52) U.S. Cl. ..... 205/98; 205/316; 205/333
(58) Field of Search ..... 205/316, 333; 438/95

(56) References Cited

U.S. PATENT DOCUMENTS 5,275,714 A * 1/1994 Bonnet et al. ..... 205/109
5,283,131 A * 2/1994 Mori et al. ..... 428/623
5,804,466 A * 9/1998 Arao et al. ..... 438/95

FOREIGN PATENT DOCUMENTS

JP 8-217443 8/1996

OTHER PUBLICATIONS

H. Sannomiya, et al., "a–Sic/a–Si/a–SiGe Multi–Bandgap Stacked Solar Cells with Bandgap Profiling," *Technical Digest of the International PVSEC–5*, p. 387, 390 (Japan, 1990), Month Not Available.
Masanobu Izaki & Takashi Omi, "Electrolyte Optimization for Cathodic Growth of Zinc Oxide Films," 143 *J. Electrochm. Soc.* pp. L53–L55 (Mar. 1996).

* cited by examiner

*Primary Examiner*—Kathryn Gorgos
*Assistant Examiner*—Erica Smith-Hicks
(74) *Attorney, Agent, or Firm*—Fitzpatrick, Cella, Harper & Scinto

(57) ABSTRACT

The present invention provides a method of producing a zinc oxide film, which comprises applying current between a conductive base member immersed in an electrodepositing bath and a counter electrode immersed in the electrodepositing bath to form a zinc oxide film on the conductive base member, wherein the electrodepositing bath is maintained at a temperature of 50° C. or more and has a temperature profile such that the temperature of the electrodepositing bath is lower in the final stage of electrodeposition than in the initial of electrodeposition. By the present method, a zinc oxide film with the excellent effect of light containment is stably produced in a short time, thereby producing a solar cell with a high efficiency at low a cost.

33 Claims, 9 Drawing Sheets

METHOD OF PRODUCING ZINC OXIDE FILM, METHOD OF PRODUCING PHOTOVOLTAIC ELEMENT, AND METHOD OF PRODUCING SEMICONDUCTOR ELEMENT SUBSTRATE

BACKGROUND OF THE INVENTION

1. Field of the Invention

The present invention relates to a method of producing a zinc oxide film, a method of producing a photovoltaic element, and a method of producing a semiconductor element substrate.

2. Related Background Art

A zinc oxide film is used in a photovoltaic element for converting sunlight to electric energy, a liquid crystal display and the like, as a transparent conductive film.

A conventional photovoltaic element composed of hydrogenated amorphous silicon, hydrogenated amorphous silicon germanium, hydrogenated amorphous silicon carbide, microcrystalline silicon, polycrystalline silicon or the like, has utilized a reflection layer at the back of a semiconductor layer so as to improve the efficiency of collection in a long wavelength range. It is desirable that such a reflection layer exhibit reflection characteristics effective in a wavelength range of 800 nm to 1200 nm. This is because such a wavelength range is so near the end of a semiconductor material band that light in the range is slightly absorbed. Metals such as gold, silver, and copper meet this requirement.

Light is contained in a predetermined wavelength range in a semiconductor layer by providing an optically transparent irregular layer. In general, the transparent irregular layer is provided between the reflection layer and the semiconductor layer to effectively utilize reflected light and improve the short circuit current density Jsc.

To prevent a deterioration in characteristics due to a shunt path, a layer made of a light-transmissive material which has conductivity, that is, a transparent conductive layer is formed between the metal layer and the semiconductor layer. These layers generally formed by vacuum deposition or sputtering exhibit improvement in the short-circuit current density (Jsc) by 1 mA/cm$^2$ or more.

As the examples of the above, the paper entitled "Effects of Light Containment in a-SiGe Solar Cell on 29p-MF-22 Stainless Steel Substrate" (Compilation of Draft Papers for Lectures at the 51st Applied Physics Conference, p. 747, 1990), the paper entitled "P-IA-15a-SiC/a-Si/a-SiGe Multi-Bandgap Stacked Solar Cell with Bandgap Profiling" (Sannomiya et al., Technical Digest of the International PVSEC-5, Kyoto, Japan, p. 381, 1990), and the like discuss the reflectance and texture structure of reflection layers consisting of silver atoms. In the above papers, a short circuit current has been increased under the influence of light containment by a combination of an irregular reflection layer consisting of two silver layers deposited at different substrate temperatures, and a zinc oxide layer. The papers also discuss how to reduce a production time by depositing a film of good quality at a high speed and how to stabilize film production by forming an uniform film on a substrate, in consideration of productivity of a zinc oxide film.

The conventional photovoltaic element with a light containment layer as described above, which has excellent photoelectric conversion characteristics, has room for improvement because it does not fully utilize light. In other words, the reflectance for light in a long wavelength range of 800 nm to 1200 nm is not zero, so that a part of light to be contained is reflected into the air, thus causing losses.

When an irregular-shaped light containment layer utilizing crystalline irregularity is formed, a film consisting of grains of sizes that are effective in light containment is poor in adhesion to a base member, while a dense film which gives good adhesion to a base member does not fully function as a light containment layer.

By vacuum deposition and sputtering methods, commonly used for film formation, high speed deposition is carried out in order to increase productivity. For example, electric power input is increased to increase the number of active species for forming a transparent conductive layer. In this case, film crystallinity may decrease, so that crystals do not grow adequately. Thus grains become small, and the surface of the transparent conductive layer becomes flat, thereby resulting in insufficient scattering to contain light.

A transparent layer used for light containment is formed by the vacuum deposition method using resistor heating or electron beams, the sputtering method, or the CVD method. For example, in the CVD method, a space where active species are present is controlled with difficulty so that the shape of film on a substrate varies, thereby reducing a production efficiency. For the sputtering method, costs of producing sputtering target material and repayments of vacuumizing equipment are high, and the material using efficiency is low. Thus, the considerable costs of producing a photovoltaic element by these methods is a barrier for industrial applications of solar cells.

Japanese Patent Application Laid-Open No. 7-23775 and the paper entitled "Electrolyte Optimization for Cathodic Growth of Zinc Oxide Films" (Masanobu Izaki, Takashi Omi, Journal of Electrochemical Soc. Vol. 143, No. 3) report that to solve the problems described above, a transparent zinc oxide film was electrochemically deposited by applying current to a counter electrode immersed in a zinc nitrate solution. This method eliminates the need for expensive vacuumizing equipment and targets, thereby significantly reducing costs of producing a zinc oxide film. Since the method allows zinc oxide to deposit even on a substrate with a large area, it is promising for producing a large-area photovoltaic element, such as a solar cell.

A zinc oxide film formed by the above method is inexpensive but has the following problems.

(1) Abnormal growth of needlelike, spherical, and dendritic shapes in the order of microns or more are liable to form on deposits, especially when current density or solution concentration is increased. It is considered that when a zinc oxide film with such abnormal growths is used as a part of a photovoltaic element, it causes the shunt of a photovoltaic element.

(2) It is likely to locally vary the grain size distribution of zinc oxide. Therefore, there is a problem in film uniformity when a zinc oxide film is deposited on a large area.

(3) A zinc oxide film deposited by this method is inferior in adhesion to a base member to films deposited by the vacuum deposition using resistor heating or electron beams, sputtering, ion plating, and CVD methods.

(4) This method produces only a smooth film, not a deposited film with irregularities having the light containing effect.

SUMMARY OF THE INVENTION

The present invention has been accomplished so as to solve the problems as described above. It is an object of the present invention to stably form a zinc oxide film having an excellent light containment effect in a shorter time, compared with conventional methods, and produce a highly efficient solar cell at low cost by using a photovoltaic element containing such a zinc oxide film.

As the results of the intensive study of the present inventor for solving the above problem, the present inventor has found the fact that in the production of a zinc oxide film by electrodeposition, an electrodepositing bath is maintained at a temperature of 50° C. or more and has a temperature profile such that the temperature of the electrodepositing bath is lower in the final stage of electrodeposition than in the initial stage of electrodeposition, thereby reducing a burnout voltage in the initial stage to make irregularities of a film surface larger. The present invention has been accomplished based on this fact.

The present invention provides a method of producing a zinc oxide film, which comprises applying current between a conductive base member immersed in an electrodepositing bath and a counter electrode immersed in the electrodepositing bath to form a zinc oxide film on the conductive base member, wherein the electrodepositing bath is maintained at a temperature of 50° C. or more and has a temperature profile such that the electrodepositing bath is lower in the final stage of electrodeposition than in the initial stage of electrodeposition.

The present invention further provides a method of producing a photovoltaic element, which comprises the steps of: forming a zinc oxide film on a conductive base member by applying current between the conductive base member immersed in an electrodepositing bath and a counter electrode immersed in the electrodepositing bath; and forming a semiconductor layer, wherein the electrodepositing bath is maintained at a temperature of 50° C. or more and has a temperature profile such that the electrodepositing bath is lower in the final stage of electrodeposition than in the initial stage of electrodeposition.

The present invention still further provides a method of producing a semiconductor element substrate, which comprises applying current between a conductive base member immersed in an electrodepositing bath and a counter electrode immersed in the electrodepositing bath to form a zinc oxide film on the conductive base member, wherein the electrodepositing bath is maintained at a temperature of 50° C. or more and has a temperature profile such that the electrodepositing bath is lower in the final stage of electrodeposition than in the initial stage of electrodeposition.

DESCRIPTION OF PREFERRED EMBODIMENTS

Figure 1:
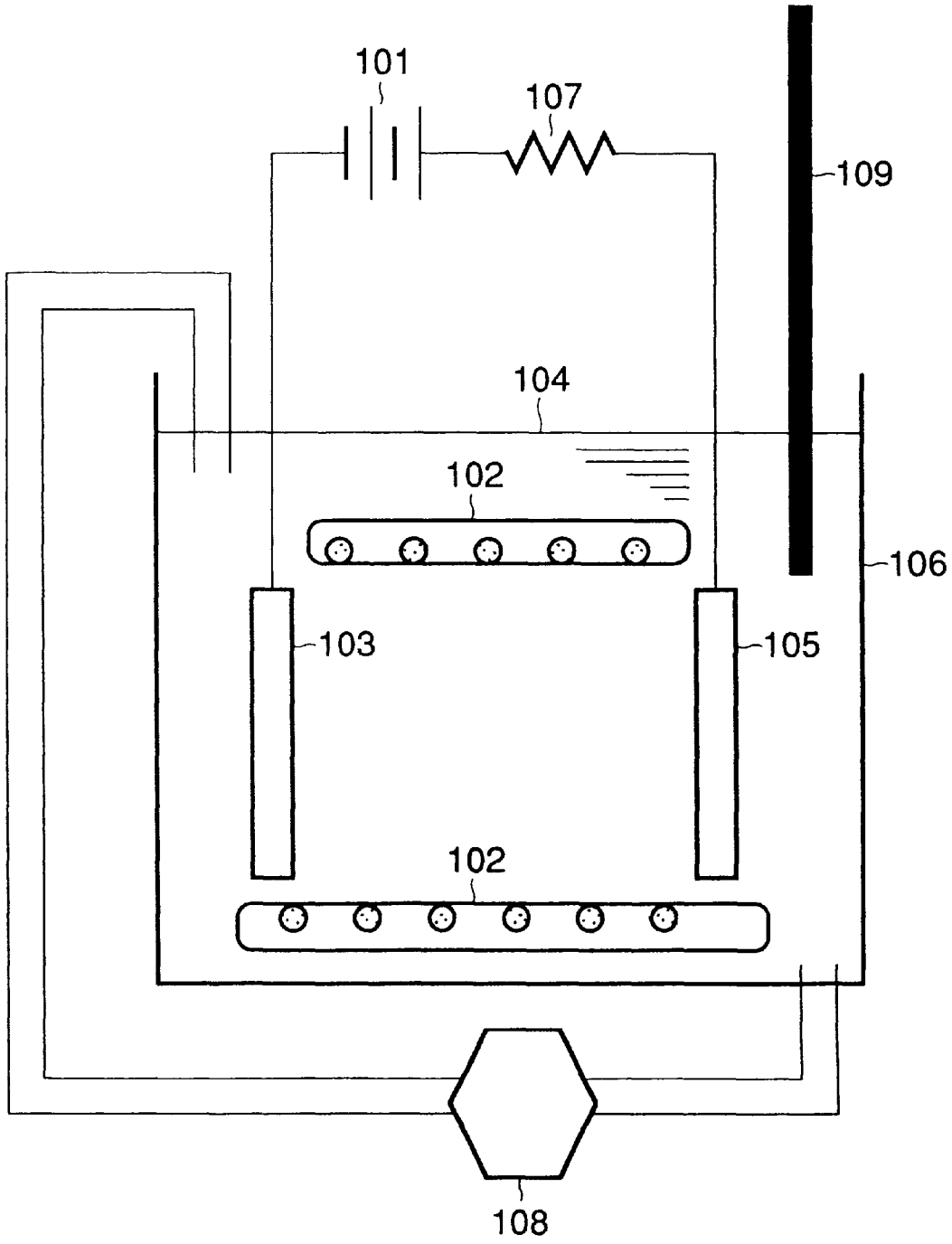
FIG. 1 is a cross-sectional view showing one example of an apparatus for executing a method of producing a zinc oxide film according to the present invention.

The apparatus shown in FIG. 1, in which a solution circulation system is omitted, was used to carry out experiments described below. Instead of a solution circulation system, a magnetic stirrer was used to always stir electrodepositing bath.

A sheet of stainless steel 430BA plate, which has an aluminum layer of 200 nm thick formed on an upper surface thereof by sputtering and a covered tape on the other surface thereof, was used as a conductive base member 103. A plate of 4-N zinc (99.99% pure) of 1 mm thick was used as a positive counter electrode 105. The conductive base member was chosen as appropriate from a stainless steel 430BA sheet of 50 mm wide, 0.12 mm to 0.15 mm thick, and 50 mm to 100 mm long.

An electrodepositing bath 104 was an aqueous solution of zinc nitrate. In the experiments, saccharose was added in the amount of 20 g/liter. The zinc nitrate concentration was varied in a range of 0.0025 mol/liter to 0.1 mol/liter. By using heaters 102 and 103, the temperature of the electrodepositing bath 104 was controlled within a range of room temperature to 85° C. which is measured by thermometer 109. An applied current was varied in a range of 0.3 mA/cm$^2$ to 100 mA/cm$^2$. Saccharose has the effect of inhibiting the abnormal growth of zinc oxide and equalizing its grain size.

The measurement parameters and the reliability test used for evaluating formed zinc oxide films are described below.

[Burnout current]

When the density of current applied to an electrodepositing bath (hereinafter referred to as "applied current density") is gradually increased, it drops sharply at a voltage (burnout voltage), bubbles occur in the bath, and the current oscillates. Because of this, zinc oxide film may grow abnormally at its surface. It is necessary to minimize detrimental effects of violent oscillation of current and voltage to inhibit this abnormal growth by lowering the burnout voltage. As described later, the burnout voltage can be controlled by changing electrodepositing bath temperature during electrodeposition, since the burnout voltage tends to decrease with increasing electrodepositing bath temperature.

[SEM]

Figure 5:
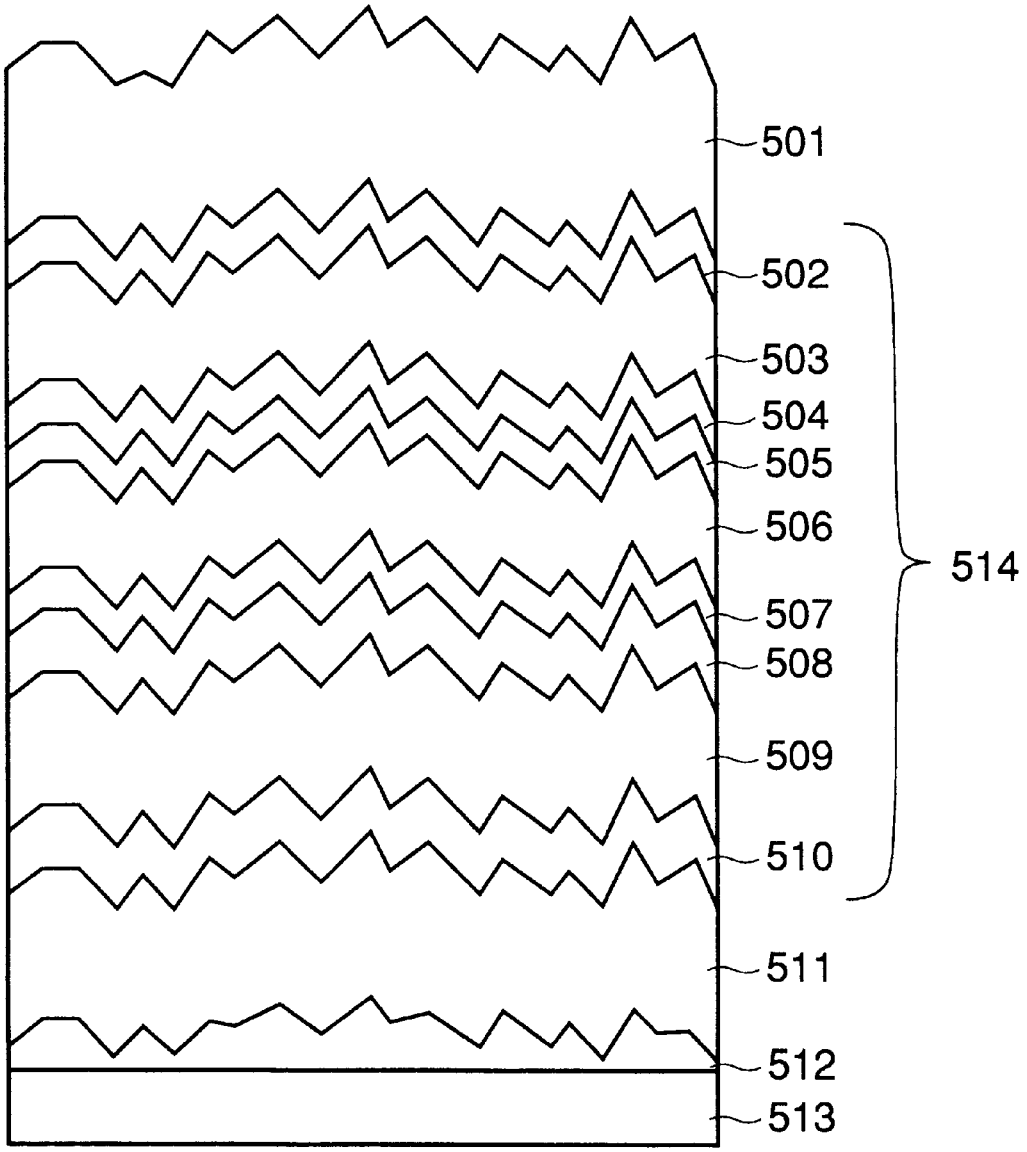
FIG. 5 is a schematic cross-sectional view showing a photovoltaic element using a zinc oxide film produced by a method according to the present invention.

SEM (scanning electron microscope) observation provides a means for evaluating a zinc oxide film formed. When a solar cell shown in FIG. 5 is provided by forming a semiconductor layer on the surface of a zinc oxide film with sharp projections of a size of several microns, a transparent electrode 501 and a transparent conductive layer 511 (zinc oxide layer) may be short-circuited, thereby reducing the output of a solar cell. When the burnout voltage was lowered by controlling electrodepositing bath temperature, the number of abnormal growths tended to decrease by counting abnormal growths under SEM observation. By controlling irregularities on a zinc oxide film surface, it is possible to reflect light with a wavelength of 600 nm to 1000 nm at the surface of a transparent conductive layer, whereby a first i-type semiconductor layer designated by reference numeral 509 can effectively absorb such light. When the diameter of zinc oxide grains is more uniform, the adhesive property of a zinc oxide film is better. Here the adhesive property of zinc oxide film refers to the adhesive property with respect to a metal layer. When a zinc oxide film is formed on a base member without a metal layer therebetween, the adhesive property of the film means the adhesive property with respect to the base member.

[X-ray diffraction]

The crystal structure of a zinc oxide film is a polycrystalline hexagonal system. The diameter of zinc oxide grains, which is estimated from an X-ray diffraction pattern is larger than the wavelength of light (around 1 $\mu$m). As c-axial orientation becomes stronger, orientation of the crystal is formed such that the hexagonal face side rises, that is, the hexagonal crystal leans against the substrate. Substrate temperature and electrodepositing bath temperature can be adjusted to control irregularities on a zinc oxide film surface. A zinc oxide film which is found from an X-ray diffraction pattern to have good orientation of zinc oxide grains provides a solar cell exhibiting high photoelectric conversion efficiency. Film orientation can be evaluated by X-ray diffraction pattern.

[HHRB test]

An HHRB test was performed at high temperature and high humidity to estimate the reliability of a solar cell using a zinc oxide film formed according to the present invention. The HHRB test is a test for determining how long a solar cell stays in an usable value range when it is reverse-biased at a temperature of 85° C. and a relative humidity of 85% or more.

[Photoelectric conversion efficiency]

The efficiency of a solar cell using a zinc oxide film made according to the present invention was measured when the cell was exposed to the quasi solar spectra of AM 1.5 with a radiation intensity of 100 mW/cm$^2$.

[Film peeling test]

This test was carried out to evaluate the mechanical strength of a solar cell using a zinc oxide film produced according to the present invention. In the test, adhesive tape applied to the front surface of the solar cell was removed to determine whether the zinc oxide film peels off from the semiconductor layer of the solar cell or from the reflection layer at the back of the cell. If no separation or slight separation occurs, the mechanical strength of a solar cell is considered to be excellent.

[Reverse bias test]

A solar cell using a zinc oxide film produced according to the present invention has a p-i-n structure and generates electricity, with the p-type layer side being a positive electrode, and the n-type layer side being a negative electrode. A reverse bias test is intended to measure a voltage at which a p-i-n junction destroys when a positive voltage and a negative voltage are increasingly applied to the p-type layer and n-type layer sides, respectively.

The measurements and tests described above were performed in Experiments 1 to 4 below.

EXPERIMENT 1

A substrate of stainless steel 430BA was used which was 50 mm long, 50 mm wide, and 0.15 mm thick. Applied current destiny was gradually increased from zero, and then when current decreased after burnout occurred, it was set to 10 mA/cm$^2$ as a constant value. A film was formed at a zinc nitrate concentration in the electrodepositing bath of 0.2 mol/liter within an electrodeposition temperature range from 50° C. to 95° C.

X-ray diffraction showed that change in the structure of a zinc oxide film formed at an electrodepositing bath temperature of 60° C. or more. A film formed at an electrodeposition temperature of 50° C. or less does not exhibit atom orientation. However, as an electrodepositing bath temperature is elevated, a diffraction peak of the c-axis of zinc oxide in wurtzite structure gradually becomes larger and microcrystalline particles in the film exhibit almost the same orientation. Variations in the half-width value of X-ray diffraction spectra showed that grains in the film formed at a higher electrodepositing bath temperature were more single-crystallized.

Increasing the electrodepositing bath temperature was found to reduce the burnout voltage. If burnout occurs, arc discharge also occurs on the surface of a substrate. The higher potential the substrate has, the more frequently arc discharge occurs, so that current markedly vibrates during electrodeposition. In comparison with the surfaces of zinc oxide films formed at different electrodepositing bath temperatures by SEM observation, abnormal growths were found on the surfaces of zinc oxide films formed at a lower temperature. Although the cause is not clearly identified, it seems that $Zn(OH)_2$ grains are grown on the surface of a substrate for growing zinc oxide by flowing overcurrent on the substrate during burnout.

In the present invention, the electrodepositing bath temperature is increased in the initial stage of electrodeposition to reduce the burnout voltage, while the temperature is lowered at the final stage of electrodeposition to enlarge irregularities on a film surface.

EXPERIMENT 2

A substrate of stainless steal 430BA was used which was 50 mm long, 50 mm wide, and 0.15 mm thick. Applied current density was set to a constant value of 20 mA/cm$^2$. The zinc nitrate concentration in an electrodepositing bath was set to 0.2 mol/liter, and electrodepositing bath temperature was kept at 85° C. Films were formed at various rotation speed of a magnetic stirrer used for stirring the bath which ranged from 20 rpm to 100 rpm. The surfaces of zinc oxide films formed were observed with SEM.

Irregularity of the thickness was not observed on the zinc oxide films formed at the rotation speed of a magnetic stirrer of 20 rpm or more. A considerable number of abnormal growths occurred on zinc oxide films at the rotation speed of the stirrer ranging from 0 to near 40 rpm. However, the number of abnormal growths decreased sharply at 40 rpm or higher, so that few abnormal growths were found in the range from 80 rpm to 90 rpm. In a solar cell produced by stacking a semiconductor layer on a zinc oxide film having abnormally grown portions, it was found that a p-type layer and an n-type layer formed a short circuit through the abnormally grown portions, thereby deteriorating the performance of the solar cell.

The results of Experiments 1 and 2 performed by the present inventor, show that the burnout voltage decreases with increasing the electrodepositing bath temperature. In addition, by properly stirring an electrodepositing bath, it is possible to control abnormal growths on a zinc oxide film. Synergistic combination of these effects provides easy and good electrodeposition.

EXPERIMENT 3

Applied current density was gradually increased from 0, and when current decreased after the burnout voltage was reached, the applied current density was kept at 10 mA/cm$^2$. Zinc oxide was electrodeposited on substrates A and B made of stainless steel 430BA, the substrate A being 50 mm long, 50 mm wide and 0.12 mm thick, and the substrate B being 100 mm long, 50 mm wide and 0.15 mm thick, for 10 minutes, with the zinc nitrate concentration in an electrodepositing bath being 0.2 mol/liter, and the electrodepositing bath temperature being 62° C.

When zinc oxide films formed were observed with SEM, larger abnormal growths were found on the film deposited on the substrate B than on that deposited on the substrate A. This is presumably because the substrate B had a larger area than the substrate A, so that a larger current flew over substrate B than over substrate A during burnout. Next, when zinc oxide was electrodeposited on a substrate B provided that in the electrodepositing bath temperature was changed from 62° C. to 70° C., the burnout voltage dropped, and the number of abnormal growths significantly decreased, although the diameter of grains slightly changed.

Thus, the results of Experiments 3 show that when substrate size is increased, electrodepositing bath temperature must be suitably adjusted depending on the size to inhibit abnormal growths due to burnout.

EXPERIMENT 4

After a substrate of stainless steel 430BA of 100 mm long, 50 mm wide and 0.15 mm thick was preheated from room temperature to a certain temperature, the substrate was immersed in an electrodepositing bath to perform electrodeposition. The temperature of a substrate preheated is referred to as "preheating temperature". The applied current density was gradually increased from 0, and when current decreased after a burnout voltage was reached, the current density was kept at the constant value of 10 mA/cm$^2$. Electrodeposition was performed at preheating temperatures of 60° C., 80° C., and 100° C.

When the preheating temperature was 60° C., burnout voltage was 24 V. As the preheating temperature increased, the burnout voltage decreased. When the preheating temperature was 100° C., the burnout voltage had dropped to below 8 V. The surfaces of zinc oxide films formed at various preheating temperatures were observed with SEM. The results showed that the number of abnormal growths decreased with increasing the preheating temperature.

Based on the results of Experiments 1 to 4, it is considered that a higher electrodepositing bath temperature allows a good zinc oxide film to grow.

The results of X-ray diffraction shows that as the electrodepositing bath temperature increases, crystals in a film are oriented. When a zinc oxide film was observed by RHEED (reflection high-energy electron diffraction), ring patterns which exhibit almost completely polycrystalline were found in the electrodepositing bath temperature range from 20 to near 80° C., and ring patterns blur in an electrodepositing bath temperature of 90° C. or more. Thus grains seem to become less oriented in an electrodepositing bath temperature of 90° C. or more.

Although the cause of the above is unknown in details, it is considered as follows. When $Zn(OH)^+$ ions are generated at an appropriately high rate, ZnO grains grow due to Van der Waals attraction on a ZnO film. The lower electrodepositing bath temperature, the smaller the diameter of crystal grains. At a higher electrodepositing bath temperature, $Zn(OH)^+$ ions are formed at a higher rate to promote crystal growth and formation of $H^+$ ions, whereby a ZnO nucleus absorbs substances other than $Zn(OH)^+$ ions which are around the ZnO nucleus to therefore make ZnO crystal grains larger. However, too many $Zn(OH)^+$ ions are assumed to form at an electrodepositing bath temperature of 90° C. or more, so that many crystal grain nuclei differing in orientation are produced on a ZnO film, whereby crystal grains becomes smaller. This in turn means that balance between the rate of forming crystal nuclei and the rate of growing a crystal is important.

Based on the results of Experiments 1 to 4, the substrate temperature during zinc oxide deposition is described below. Generally speaking, as the substrate temperature rises, radical species such as $Zn(OH)^+$ ions are given more energy and facilitates surface diffusion, thereby helping atoms reach stable positions in terms of the crystal structures. Crystal grain size should therefore become larger. Since the electrodepositing bath temperature and the substrate temperature are almost the same, the number of air bubbles to be generated on substrate is reduced, and factors interrupting the growth of zinc oxide crystals are expected to decrease.

Based on the results of Experiments 1 to 4, the temperature of an additive is discussed below. To increase the adhesion of zinc oxide film, an additive is added to an electrodepositing bath. In the present invention, carbohydrate is used as the additive to increase crystal nucleation density, thereby making crystals finer. Moreover, to increase the area of contact between a zinc oxide film and a base member which is an underlying layer of the zinc oxide film, crystal grains are made uniform in size. By increasing the temperature of an additive before it is added to an electrodepositing bath, it is possible to prevent the temperature of the bath from sharply varying during addition of the additive. When the temperature of the electrodepositing bath is higher, addition of the additive in a melted state makes the diffusion of the additive fast in the electrodepositing bath, thereby being able to reduce variations of the additive concentration distribution in the bath.

Based on the results of Experiments 1 to 4, stirring of the electrodepositing bath is discussed below. In electrolytic electrodeposition, when the speed of stirring an electrodepositing bath is high, metal components with a high reduction potential is likely to precipitate. When the stirring speed increases to excess in order to inhibit abnormal formation of $Zn(OH)_2$ powder or the like, Zn particles are likely to precipitate to thereby be unable to form a good zinc oxide film. To solve this problem, an electrodeposition solution must be stirred at an appropriate speed.

Embodiments of the present invention are described below.

Method of Forming a Zinc Oxide Film

FIG. 1 is a cross-sectional view of an apparatus for forming a zinc oxide film according to the present invention. A corrosion-resistant electrodepositing vessel 106 holds an electrodepositing bath 104 containing nitrate ions, zinc ions, and carbohydrates. To obtain a desired zinc oxide film, each concentration of nitrate ions and zinc ions is desirably in a range from 0.002 to 2.0 mol/liter, more desirably from 0.005 to 1.0 mol/liter, and most desirably from 0.025 to 0.3 mol/liter.

Sources of nitrate ions and zinc ions are not limited but may be zinc nitrate, that is, a source of both nitrate ions and zinc ions, or a mixture of a water-soluble nitrate such as ammonium nitrate which is a source of nitrate ions, and a zinc salt such as zinc sulfate which is a source of zinc ions.

The kind of carbohydrates are not limited. Thus, it is possible to use monosaccharides such as glucose and fructose, disaccharides such as aldose and saccharose, polysaccharides such as dextrin and starch, or a combination thereof.

To form a zinc oxide film having excellent uniformity and adhesive property without abnormal growths, the carbohydrate content of an electrodepositing bath ranges desirably from 0.001 to 300 g/liter and more desirably from 0.01 to 200 g/liter.

A conductive base member 103 is a cathode. A counter electrode 105 is an anode. The electrode 105 may be made of zinc, which is a component of zinc oxide to be electrodeposited, platinum, carbon or the like. However, it is desirable that zinc is used as the counter electrode.

The base member 103 as a cathode and the counter electrode 105 as an anode are connected through a load resistor 107 to a power supply 101 so that a nearly constant current flows through the base member and the counter electrode.

To form a desired zinc oxide film, current density ranges preferably from 0.1 to 100 mA/cm$^2$, more preferably from 1 to 30 mA/cm$^2$, and most preferably from 2 to 15 mA/cm$^2$.

The film forming conditions described above vary depending on the kind of a metal layer, its cross-sectional shape, and its crystallinity, and therefore they cannot be uniformly determined. In general, the higher zinc nitrate concentration, the larger zinc oxide crystal grains, and thus the surface of a film is liable to be irregular. It seems that the lower film formation temperature, the larger zinc oxide crystal grains. As the applied current density increases, the surface irregularity decreases. However, since the applied current density is almost proportional to film formation speed, it is desirable that a film is formed with an increased applied current density, in order to reduce costs of forming a transparent conductive layer made of zinc oxide.

A circulation pump 108 is used to prevent uneven layer formation by stirring an electrodepositing bath and improve the efficiency of producing a film with a high speed. In a small apparatus, a magnetic stirrer can be substituted for a solution circulation system containing such a circulation pump.

Heaters 102 and 103 and a thermocouple (not shown in the drawings) are used to monitor and control the electrodepositing bath temperature. To form a desired zinc oxide film, it is desirable that electrodeposition is carried out at a high electrodepositing bath temperature. This is because by increasing the electrodepositing bath temperature, the burn-out voltage is reduced to inhibit generation of abnormal growth on the zinc oxide film. It is preferable that the electrodepositing bath temperature is 50° C. or more. Especially, it is more preferable that the electrodepositing bath temperature range from 150 to 200° C. The atmosphere in contact with the electrodepositing bath 104 is set above atmospheric pressure in order to increase an electrodepositing bath temperature to 100° C. or more.

When the electrodepositing bath had the temperature profile such that the temperature of the bath is lower in the final stage of electrodeposition than in the initial stage of electrodeposition, the burnout voltage could be decreased in the initial stage of electrodeposition, thereby reducing the number of abnormal projections on a film. Since a reduction in number of abnormal projections on a film prevented a short circuit in a solar cell, the results of a reverse bias test were improved under the HHRB environment.

Continuous Forming Apparatus

Figure 3:
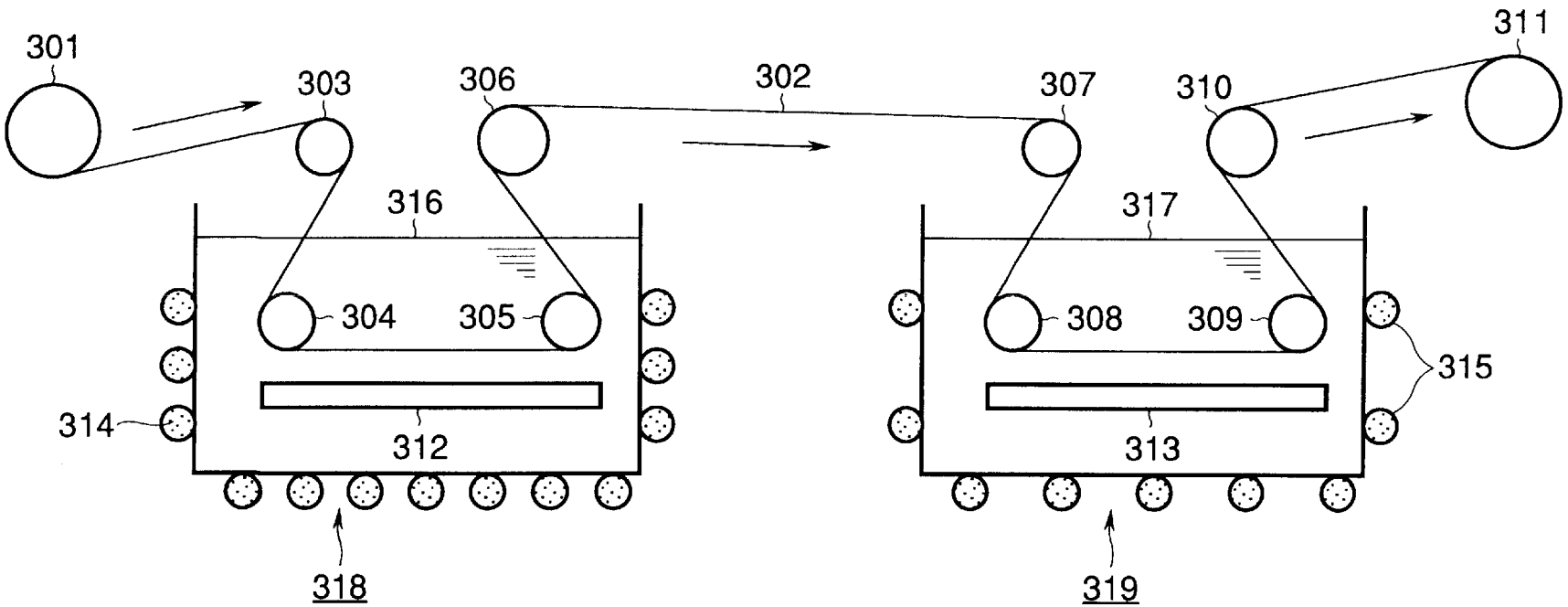
FIG. 3 is a cross-sectional view showing one example of a continuous forming apparatus for executing a method of producing a zinc oxide film according to the present invention.

FIG. 3 shows an apparatus for continuously depositing a zinc oxide layer on a flexible conductive base member 302 of a long sheet-like shape in an electrodepositing bath.

To prevent a zinc oxide film from depositing on the back of the conductive base member 302, an insulating tape (not shown in the drawings) is applied to the back. The conductive base member 302 is conveyed from a delivery roller 301 around which the base member is wound in a roll state, further conveyed many transfer rollers 303, 304, 305, 306, 307, 308, 309 and 310, and then wound up a winding-up roller 311. The diameter of the rollers must be determined according to the material of the conductive base member 302 to prevent its plastic deformation.

Heaters 314 and 315 keep a high-temperature bath vessel 318 and a low-temperature bath vessel 319 at a constant temperature, respectively so that an electrodepositing bath 316 in the high-temperature bath vessel 318 is higher in temperature than an electrodepositing bath 317 in the low-temperature bath vessel 319. By doing so, electrodeposition is carried out which has a temperature profile such that an electrodeposition temperature is lower in the final stage of electrodeposition than in the initial stage of electrodeposition.

It is possible to form a zinc oxide film at low cost by using this apparatus.

Figure 4:
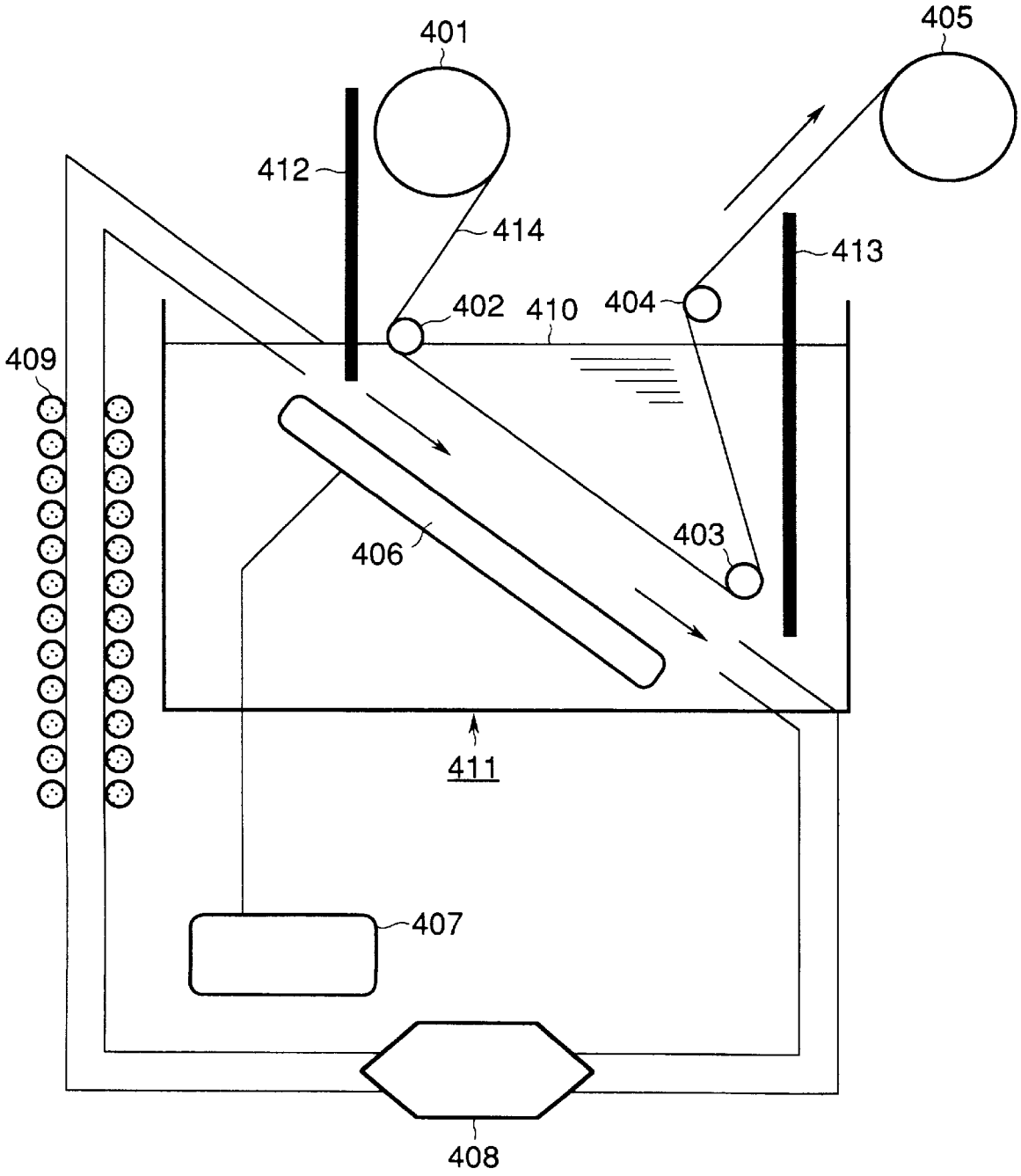
FIG. 4 is a cross-sectional view showing another example of a continuous forming apparatus for executing a method of producing a zinc oxide film according to the present invention.

FIG. 4 is a cross-sectional view of another example of an apparatus for continuously forming a zinc oxide film according to the present invention. The apparatus circulates an electrodepositing solution, heats it by using a heater 409, and returns it to an electrodepositing vessel 411. Through these steps, the apparatus causes a flow of the electrodepositing solution so that the speed of stirring the electrodepositing bath 410 is increased to prevent or reduce variation of the thickness distribution of a zinc oxide film electrodeposited on a conductive base member 414 which is conveyed via rollers 402, 403 and 404 from delivery roller 401 to wind-up roller 405. Moreover, the apparatus causes a flow of the electrodepositing bath 410 in the conveying direction of the conductive base member 414 to give the electrodepositing bath 410 a temperature profile such that the bath is lower in the final stage of electrodeposition than in the initial stage of electrodeposition.

Figure 6:
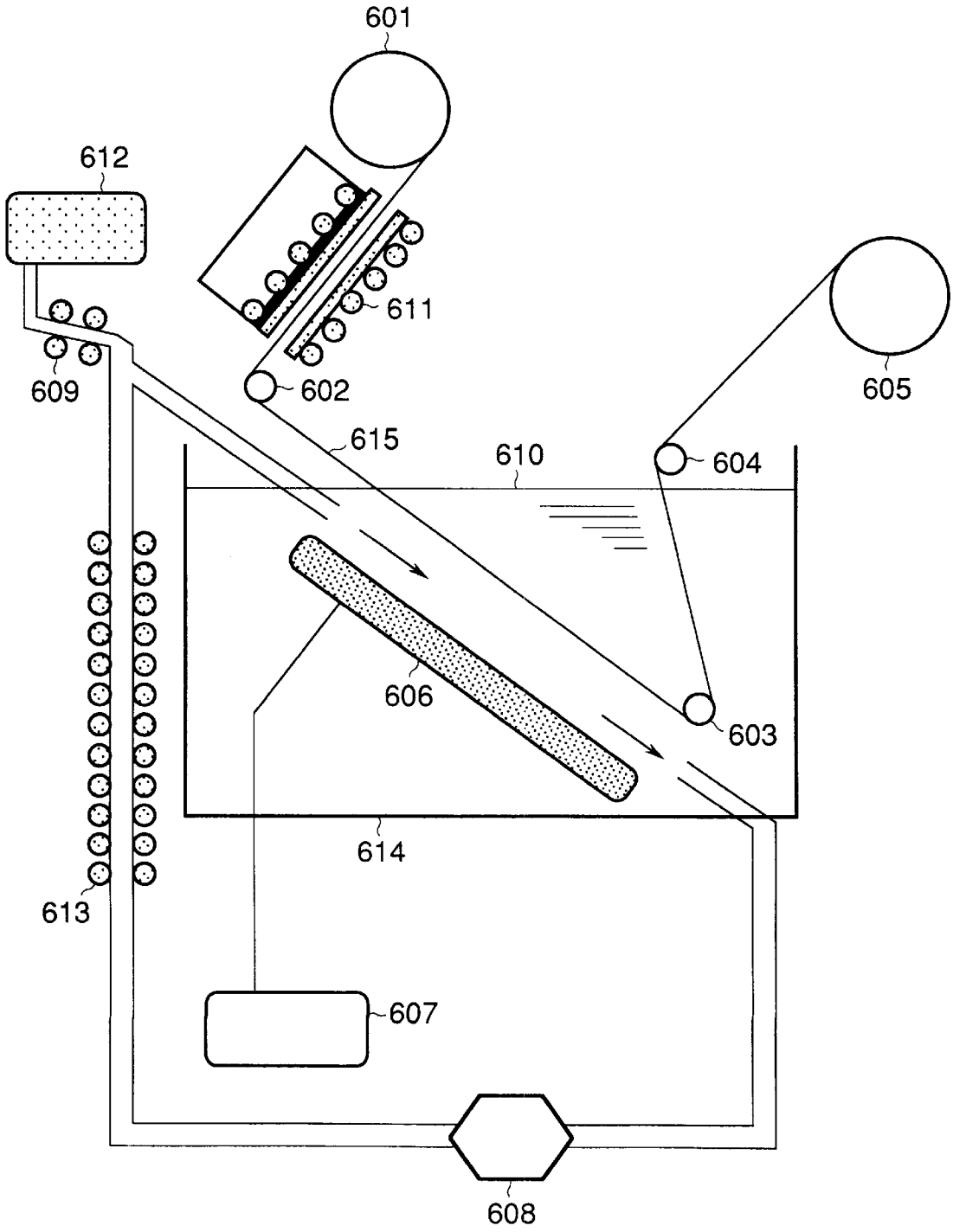
FIG. 6 is a cross-sectional view showing still another example of a continuous forming apparatus for executing a method of producing a zinc oxide film according to the present invention.

FIG. 6 is a cross-sectional view of still another example of an apparatus for continuously forming a zinc oxide film according to the present invention. The apparatus shown in FIG. 6 has a system for monitoring an electrodepositing bath temperature and a system for adding an electrodepositing bath as required, in addition to the apparatus shown in FIG. 4. A zinc nitrate solution 612 heated according to the results of temperature monitoring is occasionally added to an electrodepositing bath to maintain the pH in the bath at a constant value and to diminish an adverse effect on a predetermined temperature profile. Further, the apparatus also preheats a conductive base member 615 by using a heater 611 to diminish an adverse effect on a predetermined temperature profile the conductive base member 615 is provided by delivery roller 601, conveyed by rollers 602, 603 and 604 and picked-up by wind-up roller 605.

Figure 9:
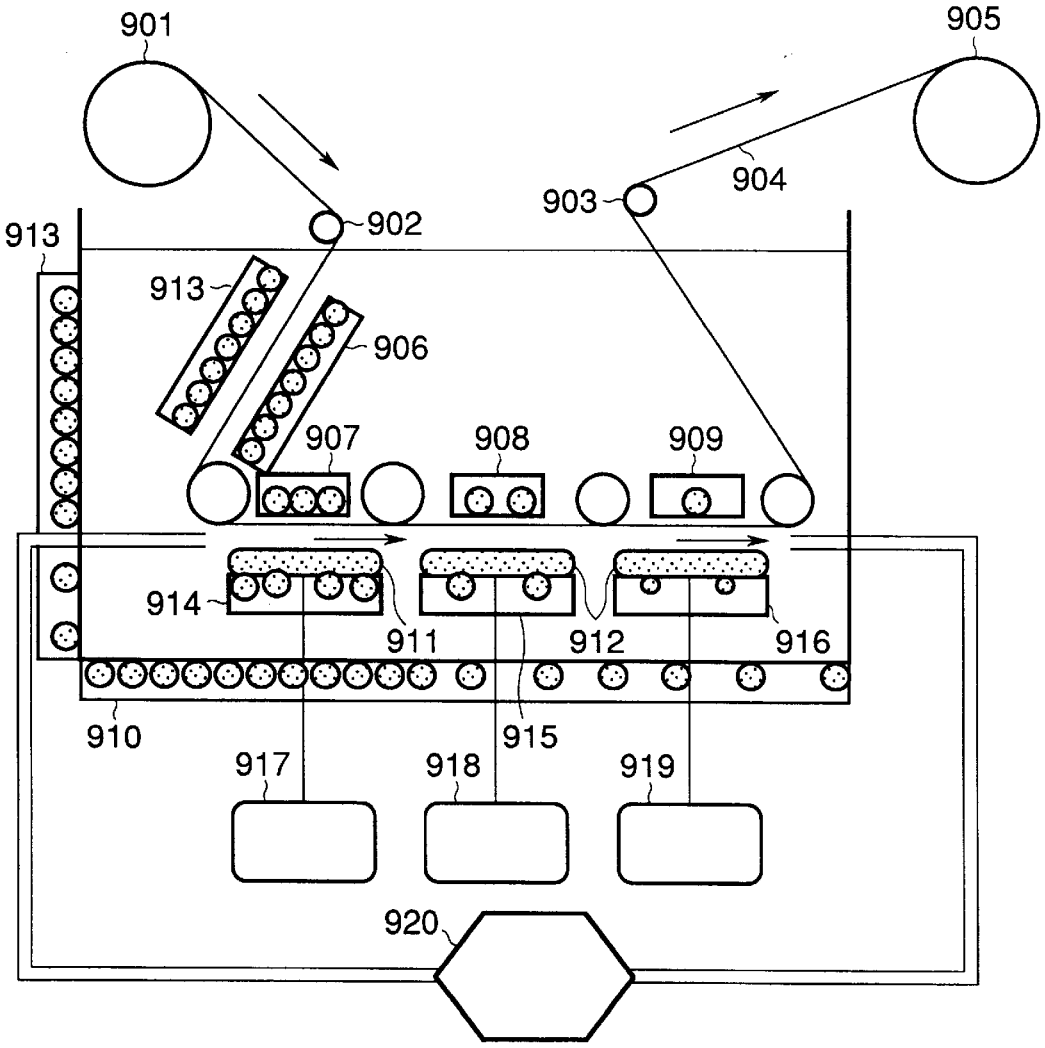
FIG. 9 is a cross-sectional view showing a further example of a continuous forming apparatus for executing a method of producing a zinc oxide film according to the present invention.

FIG. 9 is a cross-sectional view of still another example of an apparatus for continuously forming a zinc oxide film according to the present invention. As shown in this figure, heaters 910 and 913 are disposed around an electrodepositing vessel. The heater 913 is arranged so that the density of heater elements becomes progressively lower in the direction toward the bottom of the bath. This arrangement is intended to make an electrodepositing bath temperature lower at a larger depth from the solution surface of the electrodepositing bath. On the other hand, the heater 910 is arranged so that the density of heater elements becomes progressively lower in the direction of conveying a conductive base member 904. This arrangement is intended to reduce an electrodepositing bath temperature in the direction of conveying the base member. In addition, heaters 914, 915, and 916 disposed on counter electrodes 911 and 912 are arranged so that the number of heater elements is decreased in these heaters in the direction of conveying the conductive member, whereby the electrodepositing bath temperature is gradually reduced in the direction of conveying the base member. Heaters 906 and 913 are used to anneal the conductive base member immediately after it is immersed in the bath. Electric power supplies 917, 918 and 919 are connected to the counter electrodes 911 and 912. The electrodeposition bath is removed from the bottom of the electrodeposition vessel by circulation pump 908 and discharged at the top of the electrodeposition vessel.

Figure 7:
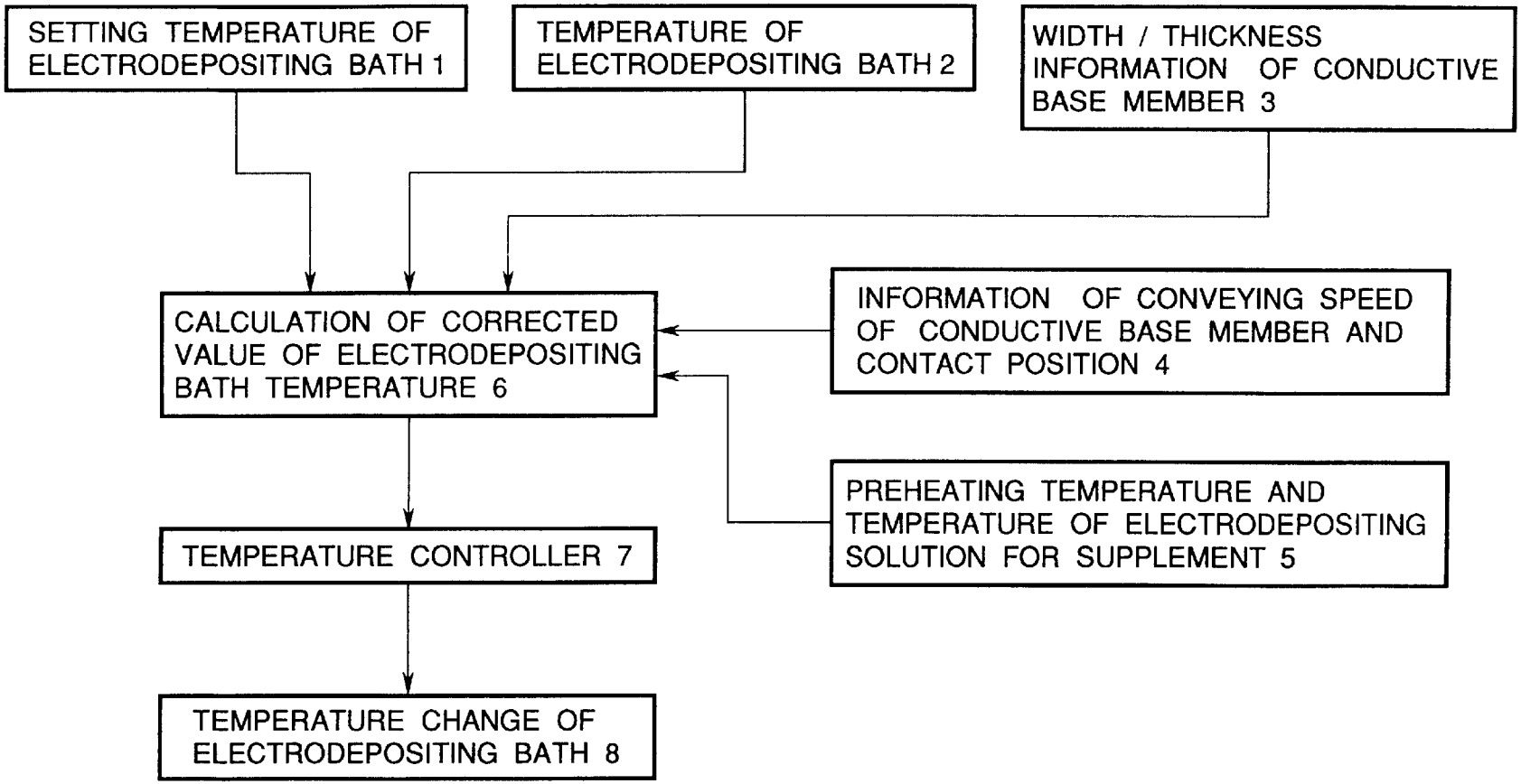
FIG. 7 is a chart showing one example of algorithm for control of electrodeposition temperature.

When used an apparatus for continuously forming a film, in order to prevent the setting temperature of the electrodepositing bath from changing due to the variation of the width of a conductive base member, it is preferable that a temperature correcting value of the electrodepositing bath is calculated from the setting temperature of the electrodepositing bath, the As width and thickness informations of the conductive base member, and a conveying speed of the conductive base member, and the temperature of the electrodepositing bath is controlled by a temperature controller on a basis of the temperature correcting value. Additionally, when the conductive base member is preheated, the temperature correcting value of the electrodepositing bath may be calculated from a preheating temperature and the above informations such as the electrodepositing bath temperature. Further, when an electrodepositing solution is supplied for supplement, the temperature correcting value of the electrodepositing bath may be calculated from the temperature of the electrodepositing solution to be supplied for supplement and the above informations such as the electrodepositing bath temperature. FIG. 7 shows one example of an algorithm for controlling the temperature profile of the electrodepositing bath. Here, the temperature correcting value of the electrodepositing bath is calculated from the setting temperature 1 of the electrodepositing bath, the electrodepositing bath temperature 2, the width and thickness informations 3 of the conductive base member, the conveying speed of the conductive base member, and a contact position information 4, a preheating temperature and a temperature of an electrodepositing solution for supplement 5, and then the temperature of the electrodepositing bath is controlled by a temperature controller 7 on a basis of the temperature correcting value. The contact position information is an information showing a starting point of stabilizing the electrodeposition. The temperature controller has, for example, a heat generating means such as a heater, and a heat radiating and cooling means such as a radiator, means for controlling them.

Conductive Base Member

A conductive base member used in the present invention is composed of a magnetic or non-magnetic metal as a matrix. Among them, stainless steel, steel, copper, brass, and aluminum plates are relatively inexpensive and suitable for the base member.

These metal plates may be cut into a certain shape or used in the shape of a long sheet, depending on its thickness. Since a long sheet-like base member can be rolled into a coil, it is suitable for continuous production and easy to store and transport. In some applications, it is possible to use as the conductive base member, a composite obtained by forming a semi-conductive film (metal film) on a liquid crystal substrate of silicon or the like, or a supporting material of glass, ceramic, resin or the like. A metal plate used as a conductive base member may be polished. However, for example, a bright-annealed stainless steel plate, when finished well, may be used as such.

Application to Photovoltaic Element

FIG. 5 is a schematic cross-sectional view of a photovoltaic element using a zinc oxide film produced by the method of the present invention. The present invention is not limited to the structure of the photovoltaic element as shown in FIG. 5.

In FIG. 5, a reference numeral 513 denote a supporting member; 512, a metal layer; 511, a transparent conductive layer; 504, 507, and 510, n-type semiconductor layers; 503, 506, and 509, i-type semiconductor layers; 502, 505, and 508, p-type semiconductor layers; and 501, a transparent electrode. Here, a combination of the supporting member 513 and the metal layer 512 is called as a conductive base member.

The photovoltaic element shown in FIG. 5 generates electric power by receiving incident light from the side of the transparent electrode 501. However, a photovoltaic element is conceivable which generates electric power by receiving incident light from the side of the supporting member. In this photovoltaic element, the layers shown in FIG. 5 may stacked on the supporting member 513 in the reverse order of the order shown in FIG. 5.

Layers constituting a photovoltaic element according to the present invention are described in detail blow.

Metal Layer 512

A metal layer used in the present invention is an electrode disposed between a semiconductor layer and a supporting member.

Materials for the metal layer include metals such as gold, silver, copper, aluminum, nickel, iron, chromium, molybdenum, tungsten, titanium, cobalt, tantalum, niobium, and zirconium, and alloys such as stainless steel. Metals with a high reflectance such as aluminum, copper, silver and gold are preferable as the metal layer. A metal layer made of a metal with a high reflectance can also serve as a reflection layer. In other words, light which is not absorbed by the semiconductor layer 514 can be reflected back by the metal layer 512 into the semiconductor layer 514.

Transparent Conductive Layer 511

The transparent conductive layer is disposed between the metal layer 512 and the semiconductor layer 514 mainly for the following purposes. Irregular reflection at the back surface of a photovoltaic element is enhanced, and light is contained in the photovoltaic element by using multiple interference due to film, thereby extending the light path in the semiconductor layer 514 to increase short circuit current (Jsc) in the photovoltaic element. Further, the shunt of a photovoltaic element is prevented which occurs due to diffusion or migration of a metal used in the metal layer 512, also serving as a back electrode, into the semiconductor layer 514. In addition, when the transparent conductive layer has some electric resistance, a shunt between the metal layer 512 and the transparent electrode 501 which is caused by defects such as pinholes in the semiconductor layer 514 can be prevented.

The transparent conductive layer 511 is required to have both of a high transmittance for light having wavelengths which the semiconductor layer 514 can absorb and a moderate resistivity. The transmittance of the transparent conductive layer is desirably 80% or more, more desirably 85% or more, and most desirably 90% or more for light with a wavelength of 650 nm or longer.

Semiconductor Layer 514

Materials for a semiconductor layer used in the present invention include Group IV elements of the periodic table such as Si, C and Ge, and Group IV element alloys such as SiGe, SiC and SiSn.

Preferable materials for a photovoltaic element according to the present invention include Group IV element-based semiconductor materials such as a-Si:H (an abbreviation for hydrogenated non-crystalline silicon), a-Si:F, a-Si:H:F, a-SiGe:H, a-SiGe:F, a-SiGe:H:F, a-SiC:H, a-SiC:F, and a-SiC:H:F, and Group IV element alloy-based non-single-crystalline semiconductor materials.

Valence electron control and bandgap control can executed in a semiconductor layer. Specifically, only a raw material compound containing an element which exercises valence electron control or bandgap control, or a mixture of the raw material compound and the material gases for forming a deposited film or the diluting gases is introduced into a space for forming a film.

Valence electron control is carried out in a semiconductor layer to form at least one p-i-n junction therein. A plurality of p-i-n junctions can be stacked to form a semiconductor layer having a so-called stack cell structure.

Methods for forming a semiconductor layer include CVD methods such as microwave plasma CVD, RF plasma CVD, optical CVD, thermal CVD and MOCVD methods; deposition methods such as EB deposition, MBE, ion plating and ion beam methods; a sputtering method; a spray method; and a printing method. In industry, the plasma CVD method is preferably used in which a raw material gas is decomposed by using plasma to deposit a film on a substrate. A batch type apparatus or a continuous forming apparatus can be suitably used as a reaction apparatus therefor.

Transparent Electrode 501

A transparent electrode used in the present invention has a light-transmissive property and is an electrode on the side of incident light. The transparent electrode, when its thickness is optimized, also serves as a reflection prevention film. The electrode is required to have both of a high transmittance for light having wavelengths which the semiconductor layer 514 can absorb and a moderate resistivity. The transmittance of the transparent electrode is desirably 80% or more and more desirably 85% or more for light with a wavelength of 550 nm or longer. Its resistivity is desirably $5\times10^{-3}$ Ω·cm or less and more desirably $1\times10^{-3}$ Ω·cm or less.

Preferable materials for the transparent electrode include conductive oxides such as $In_2O_3$, $SnO_2$, ITO($In_2O_3$+$SnO_2$), ZnO, CdO, $Cd_2SnO_4$, $TiO_2$, $Ta_2O_5$, $Bi_2O_3$, $MoO_3$ and $Ns_xO_3$, and a mixture thereof. An element (dopant) may be added to these compounds so as to vary their conductivity.

Al, In, B, Ga, Si, F, or the like is preferably used as a dopant for a transparent electrode made of ZnO; Sn, F, Te, Ti, Sb, Pb, or the like, for a transparent electrode made of $In_2O_3$; and F, Sb, P, As, In, Tl, Te, W, Cl, Br, I, or the like, for a transparent electrode made of $SnO_2$.

Preferable methods for forming the transparent electrode include spray, CVD, plasma CVD, electrodeposition, vacuum deposition, ion deposition, sputtering, spin-on, and dipping methods.

EXAMPLE 1-1

The apparatus shown in FIG. 1 was used to form a zinc oxide film.

A stainless steel 430BA sheet of about 5 cm long, about 5 cm wide and 0.12 mm thick, having an aluminum layer stacked on one side thereof, was used as the conductive base member 103. The counter electrode 105 was made of a 4-N zinc plate 1 mm thick. The conductive base member 103 was a cathode, and the counter electrode was an anode.

The electrodepositing bath 104 was an aqueous solution of zinc nitrate. 20 g/liter of saccharose was added to the solution. The zinc nitrate concentration and the applied current density were set to 0.025 mol/liter and 10 mA/cm$^2$, respectively.

Figure 2A:
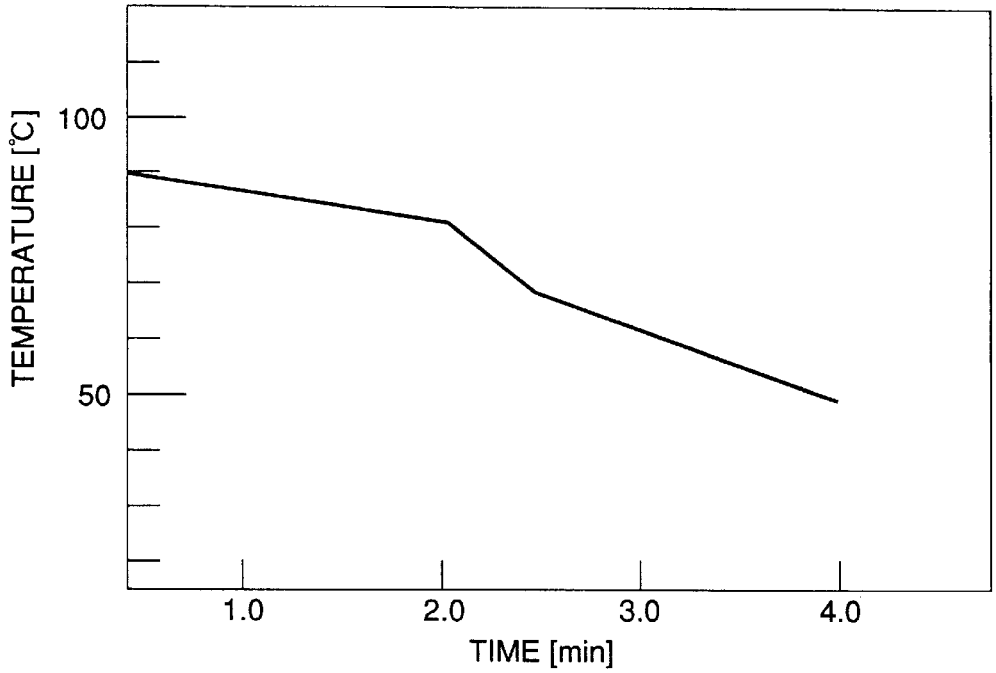
FIGS. 2A and 2B are graphs showing the relationship between time and temperature and the relationship between time and current density in Example 1, respectively.

Electrodeposition was performed while the temperature of the electrodepositing bath 104 was gradually lowered from 90 to 80° C. as shown in FIG. 2A. Then the conductive base member 103 was taken out and cooled to 70° C. It was immersed in the electrodepositing bath 104 again. Next, electrodeposition was further performed for 1.5 minutes.

The resulting zinc oxide film deposited was about 1 μm thick. It was consisted of crystal grains of about 0.03 μm in size, which were found by X-ray diffraction to be oriented in the direction of the c axis.

The plasma CVD method was used to form a semiconductor layer by depositing a n-type amorphous Si layer of a thickness of 20 nm, an i-type amorphous Si layer of a thickness of 200 nm, and a p-type microcrystalline Si layer to a thickness of 14 nm in this order. An ITO layer was further deposited to a thickness of 65 nm in an oxygen atmosphere by sputtering to form a transparent electrode capable of preventing reflection. On the electrode, a grid electrode of silver was further formed. The photovoltaic element thus produced is referred to as "element E1-1".

The short circuit current density Jsc of the element E1-1was measured under quasi sunlight to be 11.0 mA/cm$^2$.

EXAMPLE 1-2

The apparatus shown in FIG. 1 was used to form a zinc oxide film.

The same conductive base member 103 and counter electrode 105 as in the case of Example 1-1 were used for this example.

The electrodepositing bath 104 was an aqueous solution of zinc nitrate. 40 g/liter of saccharose was added to the solution. The zinc nitrate concentration was set to 0.025 mol/liter.

Figure 2B:
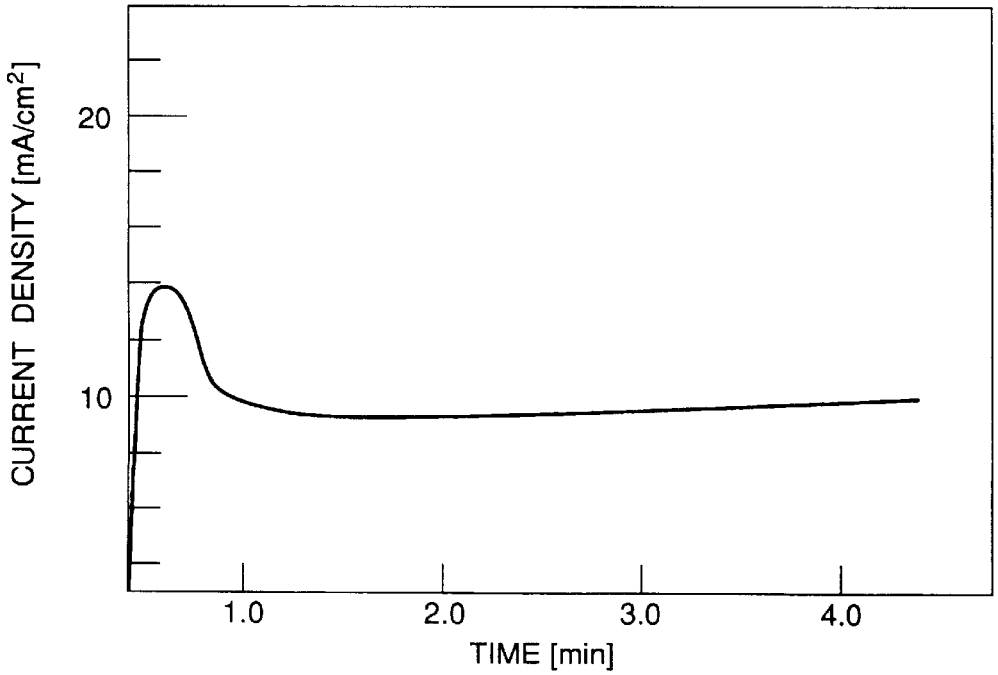

Immediately after the conductive base member preheated to 200° C., the conductive base member 103 was immersed in an electrodepositing bath 104 to perform electrodeposition. Applied-current density was increased from zero as shown in FIG. 2B. When it reached 14 mA/cm$^2$, burnout occurred, and current oscillated. About one minute later, the applied current density settled at 10 mA/cm$^2$. Then electrodeposition was further performed for 3.5 minutes to deposit another zinc oxide film. The temperature of the electrodepositing bath was 90° C. in the initial stage of electrodeposition and 80° C. at the end of electrodeposition.

As in the case of Example 1-1, the plasma CVD method was used to form a semiconductor layer by depositing a n-type amorphous Si layer of a thickness of 20 nm, an i-type amorphous Si layer of a thickness of 200 nm, and a p-type microcrystalline Si layer to a thickness of 14 nm in this order. An ITO layer was deposited to a thickness of 65 nm in an oxygen atmosphere by sputtering to form a transparent electrode capable of preventing reflection. On the electrode, a grid electrode of silver was formed. The photovoltaic element thus made is referred to as "element E1-2".

An HHRB test was performed on the element E1-2. When the element E1-2 was placed in a 85° C., 85% RH environmental test box and reverse-biased at one volt to monitor the element over time, it stabilized in a 20-hour usable range.

COMPARATIVE EXAMPLE 1

A photovoltaic element was produced in the same way as in the case of Example 1-2 except that a conductive base member was not preheated. This element is referred to as "element R1".

The short circuit current density Jsc of the element R1 was measured under quasi sunlight to be 9.0 mA/cm$^2$. The element E1-1 was found to be superior to the element R1. When an environmental test was performed on the element R1 under the same conditions as the element E1-2 (85° C., 85% RH, 1V reverse bias), the element R1 stayed in a usable range for only five hours. This showed that the element E1-2 is superior to the element R1.

EXAMPLE 2

The apparatus shown in FIG. 3 was used to form a zinc oxide film.

A stainless steel 430BA sheet having an aluminum layer electrodeposited on one surface thereof was used as a conductive base member 302. The base member 302 was conveyed at a speed of 60 inches/min, and the tension applied to the base member was set to 10 kg. A tension adjusting clutch (not shown in the drawings) in a winding-up roller 311 controls the tension.

The conductive base member 302 is a cathode, while counter electrodes 312 and 313 made of zinc are anodes.

An electrodepositing bath 316 in a high-temperature bath vessel 318 was an aqueous solution of zinc nitrate. 20 g/liter of saccharose was added to the solution. The zinc nitrate concentration, solution temperature, and applied current density were set to 0.025 mol/liter, 85° C., and 18 mA/cm$^2$, respectively. In electrodeposition reaction for one minute, a zinc oxide film of about 1 $\mu$m was deposited. An electrodepositing bath 317 in a low-temperature bath vessel 319 was an aqueous solution of zinc sulfate. 10 g/liter of dextrin was added to the solution. The zinc sulfate concentration, solution temperature, and applied current density were set to 0.025 mol/liter, 60° C., and 10 mA/cm$^2$, respectively. The zinc oxide film formed in the lower-temperature bath vessel 319 consisted of crystal grains of about 0.02 $\mu$m in size, which were found by X-ray diffraction to be oriented in the direction of the c axis.

After the zinc oxide film was formed, the plasma CVD method was used to deposit a n-type amorphous Si layer of a thickness of 20 nm, an i-type amorphous Si layer of a thickness of 200 nm, and a p-type microcrystal Si layer of a thickness of 14 nm in this order. An ITO layer was deposited to a thickness of 65 nm in an oxygen atmosphere by sputtering to form a transparent electrode capable of preventing reflection. On the electrode, a grid electrode of silver was formed. The photovoltaic element thus produced is referred to as "element E2".

COMPARATIVE EXAMPLE 2

A photovoltaic element was produced in the same way as in the case of Example 2 except that zinc oxide was deposited by sputtering. The produced element is referred to as "element R2".

The element E2 exhibited 1.2 times the photoelectric conversion efficiency of the element R2.

EXAMPLE 3

The apparatus shown in FIG. 4 was used to form a zinc oxide film.

A stainless steel 430BA sheet having a copper layer stacked on one surface thereof by sputtering was used as a conductive base member 414. The base member 414 was conveyed at a speed of 30 inches/min and the tension applied to the base member was set to 15 kg.

The conductive base member 414 is a cathode, while a counter electrode 406 made of zinc and buffed is an anode. An electric power supply 407 is connected to counter electrode 406.

An electrodepositing bath 410 was sucked at the bottom of an electrodeposition vessel 411 by a circulation pump 408, heated to 98° C. by a heater 409, and discharged at the top of the electrodeposition vessel 411. Distribution of the temperature of the electrodepositing bath 410 was sloped from the top of the vessel 411 toward its bottom to control the shape of zinc oxide (ZnO) grains growing on the surface of a conductive base member 414. Thermometers 412 and 413 monitored the temperature of the electrodepositing bath 410. The thermometer 412 for monitoring the temperature at an upper part of the electrodepositing bath 410 read 98° C., while the thermometer 413 for monitoring the temperature at a lower part of the electrodepositing bath 410 read 85° C. A constant flow from the top of the electrodepositing bath to the bottom stirred the electrodepositing bath.

The zinc nitrate concentration and saccharose concentration in the electrodepositing bath were set to 0.025 mol/liter and 300 g/liter, respectively. The applied current density was set to 10 mA/cm$^2$. The conductive base member 414 was conveyed at a speed of 2 m/min. After electrodeposition, zinc oxide was found to be deposited to a thickness of 1.4 $\mu$m. Zinc oxide crystal grains at the interface between the zinc oxide film and the metal layer were uniform and the dense film was tight, and therefore the film had a good adhesive property.

By using a plasma CVD apparatus, a semiconductor layer having a triple structure was formed by a roll-to-roll method on a substrate having a hexagonal-system polycrystalline zinc oxide layer deposited thereon. By using a mixture of silane, phosphine and hydrogen gases, the substrate was heated to 340° C., and a RF power of 400 W was supplied to form a n-type layer. Then using a mixture of silane, germane and hydrogen gases, the substrate was heated to 450° C., and microwave power was supplied to form an i-type layer. Next, the substrate was cooled to 250° C., and a mixture of boron trifluoride, silane and hydrogen gases was used to form a p-type layer. This p-i-n layer is called a bottom p-i-n layer. Next, a middle p-i-n layer was formed in the same way as the bottom p-i-n layer except that a higher mixing ratio of silane and german was used compared with formation of the bottom p-i-n layer when the i-type layer in the middle p-i-n layer was formed, that is, except that the flow rate of silane was increased. Then, a top p-i-n layer was formed in the same way as the bottom p-i-n layer except that a mixture of silane and hydrogen gases was used to form the i-type layer in the top p-i-n layer. After the bottom, middle, and top p-i-n layers were completed, ITO was deposited to form a transparent electrode layer 501 using a sputtering apparatus by the roll-to-roll method. Finally, an electrode was formed with silver paste. The produced photovoltaic element is referred to as "element E3".

COMPARATIVE EXAMPLE 3

A photovoltaic element was produced under the same conditions as in the case of Example 3 except that a zinc oxide film was formed by the sputtering method. The produced photovoltaic element is referred to as "element R3".

An HHRB test was performed on the elements E3 and R3. These elements were placed in a 85° C., 85% RH environmental test box and reverse-biased at a voltage of 2 V to monitor characteristic changes with the lapse of time. Twenty minutes after the test started, the element R3 reached a shunt level at which the element cannot be used and became unusable after one hour of testing. On the other hand, the element E3 stayed for 20 hours in an usable range. The element E3 was found to be superior to the element R3.

EXAMPLE 4-1

An apparatus in FIG. 6 was used to form a zinc oxide film.

A stainless steel 430BA sheet having a silver layer stacked on one surface thereof by sputtering was used as a conductive base member 615. The base member 615 was conveyed at a speed of 20 inches/min and the tension applied to the conductive member was set to 10 kg.

The conductive base member 615 is a cathode, while a counter electrodes 606 made of zinc and buffed is an anode. The conductive base member 615 was preheated by a heater 611 to 95° C. and moved into an electrodepositing bath 610. Rolls were preheated before electrodeposition to reduce the number of abnormal growths as in Experiment 4.

An electrodepositing bath 610 was sucked at the bottom of an electrodeposition vessel by a circulation pump 608, heated to 95° C. by a heater 613, and discharged at the top of the electrodeposition vessel 614. Distribution of the temperature of the electrodeposition bath 610 was sloped from the top of the vessel 614 toward its bottom to control the shape of zinc oxide (ZnO) grains growing on the conductive base member 615. Thermometers (not shown in the drawings) monitored the temperature of the electrodeposition solution 610. One thermometer for monitoring the temperature at an upper part of the electrodepositing bath 610 read 95° C., while the other thermometer for monitoring the temperature at a lower part of the electrodepositing bath 610 read 87° C.

The zinc nitrate concentration and saccharose concentration in the electrodepositing bath were set to 0.025 mol/liter and 300 g/liter, respectively. The applied current density was set to 10 mA/cm$^2$. Based on data obtained by monitoring the concentration of the electrodepositing bath, the aqueous solution of zinc nitrate which was heated was added to the electrodepositing bath as necessary to keep the pH of the bath constant and reduce an adverse effect on the temperature profile established. The conductive base member was conveyed at a speed of 2 m/min. After electrodeposition, a zinc oxide film was found to be deposited to a thickness of 1.4 $\mu$m.

By using a plasma CVD apparatus, a semiconductor layer having a triple structure was formed with the roll-to-roll method on a substrate having a hexagonal-system polycrystalline zinc oxide layer deposited thereon. By using a mixture of silane, phosphine and hydrogen gases, the substrate was heated to 340° C., and a RF power of 400 W was supplied to form a n-type layer. Then, by using a mixture of silane, germane and hydrogen gases, the substrate was heated to 450° C., and microwave power was supplied to form an i-type layer. Next, the substrate was cooled to 250° C., and a mixture of boron trifluoride, silane and hydrogen gases was used to form a p-type layer. This p-i-n layer is called a bottom p-i-n layer. Next, a middle p-i-n layer was formed in the same way as the bottom p-i-n layer, except that a higher mixing ratio of silane and german was used compared with the bottom p-i-n layer when the i-type layer in the middle p-i-n layer was formed, that is, except that the flow rate of silane was increased. Then, a top p-i-n layer was formed in the same way as the bottom p-i-n layer except that a mixture of silane and hydrogen gases was used to form the i-type layer in the top p-i-n layer. After the bottom, middle, and top p-i-n layers were completed, ITO was deposited to form a transparent electrode layer 501 using a sputtering apparatus by the roll-to-roll method. Finally, an electrode was further formed thereon with silver paste. The produced photovoltaic element is referred to as "element E4-1".

EXAMPLE 4-2

A photovoltaic element was produced in the same way as in the case of Example 4-1 except that the preheating temperature was set to 100° C. and that 10 ml/min of an aqueous zinc nitrate solution 612 (0.05 mol/liter) heated to 100° C. by using a heater 609 was added to the electrodepositing bath 610. The produced element is referred to as "element E4-2".

The thermometer for monitoring the temperature at an upper part of the electrodepositing bath 610 read 70° C., while the thermometer for monitoring the temperature at a lower part of the electrodepositing bath 610 read 60° C.

COMPARATIVE EXAMPLE 4

A photovoltaic element was produced under the same conditions as in the case of Examples 4-1 and 4-2 except that a zinc oxide film was formed by the sputtering method. The produced element is referred to as "element R4".

An HHRB test was performed on the elements E4-1, E4-2, and R4. These elements were placed in a 85° C., 85% RH environmental test box and reverse-biased at a voltage of 1.5 V to monitor its characteristic changes with the lapse of time. In the test, the elements E4-1 and E4-2 stayed in an usable range longer by 20 hours or more than the element R4, that is, the elements E4-1and E4-2 exhibited high stability.

EXAMPLE 5

A photovoltaic element was produced in the same way as in the case of Example 4-2. The produced element is referred to as "element E5". Algorithm shown in FIG. 7 was used to maintain the temperature profile of an electrodepositing bath at a constant value. That is, the calculation of a temperature correcting value 6 of an electrodepositing bath was carried out based on the setting temperature 1 of the electrodepositing bath, an electrodepositing bath temperature 2, information 3 on the width and thickness of a conductive base member, the conveying speed of the conductive base member and a contact position information 4, a preheating temperature and the temperature of an electrodepositing solution for supplement 5, and then the electrodepositing bath temperature was controlled by a temperature controller on a basis of the temperature correcting value. In the present example, heaters 609, 611 and 613 were used so as to control the electrodepositing bath temperature.

COMPARATIVE EXAMPLE 5

A photovoltaic element was produced under the same conditions as in the case of Examples 5-1 except that a zinc oxide film was formed by the sputtering method. The produced element is referred to as "element R5".

An HHRB test was performed on the elements E5 and R5. These elements were placed in a 85° C., 85% RH environmental test box and reverse-biased at a voltage of 1.5 V to monitor their characteristic changes with the lapse of time. In the test, the elements E5 stayed in an usable range longer by 30 hours or more than that of the element R5, that is, the element E5 exhibited high stability. A zinc oxide film was adhered more uniformly in the element E5 than in element R5, whereby the present invention improved the yield rate of a good product.

EXAMPLE 6

By using the apparatus shown in FIG. 6, a zinc oxide film was formed in a pressurizing chamber, which can be pressurized to 20 MPa.

A zinc oxide film was formed in the same way as in the case of Example 4-2 expect that the pressure in the chamber was set to 15 MPa, a conductive base member 615 was preheated to 200° C., and an electrodepositing solution and an aqueous zinc nitrate solution 612 were heated to 230° C. by using a heater 613 and a heater 609, respectively.

Thermometers (not shown in the drawings) monitored the temperature of an electrodepositing bath 610. One thermometers for monitoring the temperature at an upper part of the electrodepositing bath 610 read 200° C., while the other thermometer for monitoring the temperature at a lower part of the electrodepositing bath 610 read 150° C.

Since in the present example, electrodeposition was performed at a pressure higher than atmospheric pressure, electrodeposition could be carried out at 100° C. or more. Since electrodeposition could be carried out in the electrodepositing bath at a higher temperature, the burnout voltage was significantly reduced. Accordingly, a zinc oxide film could be electrodeposited under a high pressure which had a fewer abnormal growth than that electrodeposited at room temperature. A p-i-n semiconductor layer with a triple structure, a transparent electrode layer, and an electrode made of silver paste were formed on the resulting zinc oxide film.

When the photovoltaic element produced in the present example was observed with SEM, it was found to have half as many abnormal growths as a photovoltaic element using zinc oxide film formed by the sputtering method.

EXAMPLE 7

The apparatus shown in FIG. 9 was used to form a zinc oxide film.

A conductive base member 904 was the same as in the case of Example 4-1. The base member 904 was processed at a rate of 10 inches/min, and the tension applied to the base member was set to 10 kg.

The conductive base member 904 is a cathode, while counter electrodes 911 and 912 made of zinc are anodes. By using heater 906 and 913, the conductive base member 904 is preheated to 97° C. immediately after it entered an electrodepositing bath.

The zinc nitrate concentration and saccharose concentration in the electrodepositing bath were set to 0.7 mol/liter and 10 g/liter, respectively. The applied current density was set to 2 mA/cm$^2$.

Figure 8A:
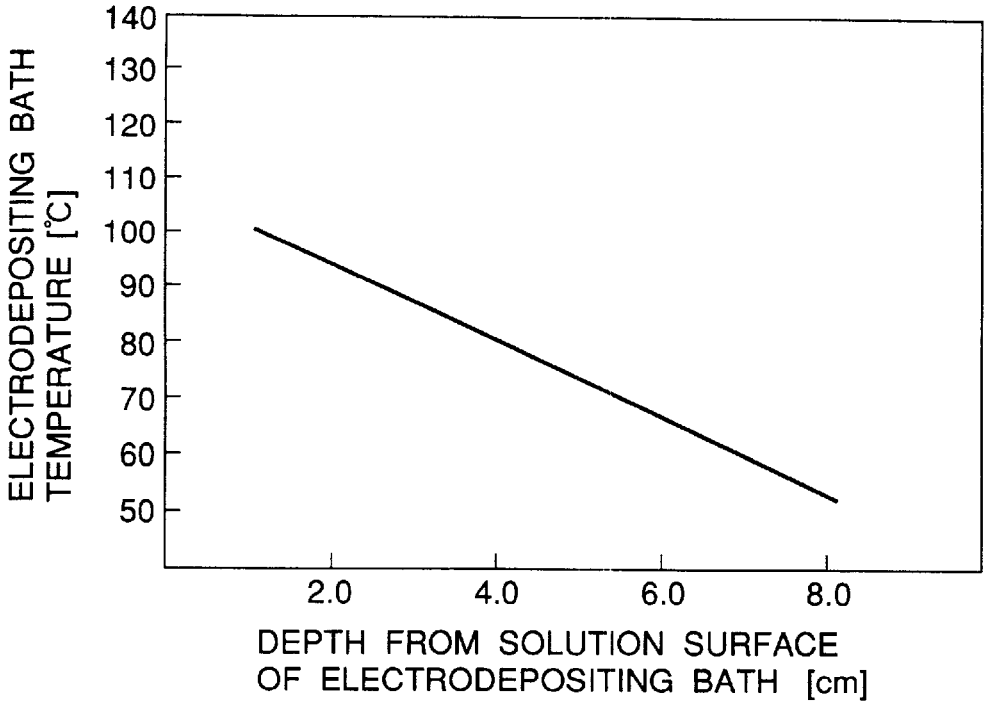
FIGS. 8A and 8B are graphs showing a temperature distribution and variation in current density in Example 7, respectively.
Figure 8B:
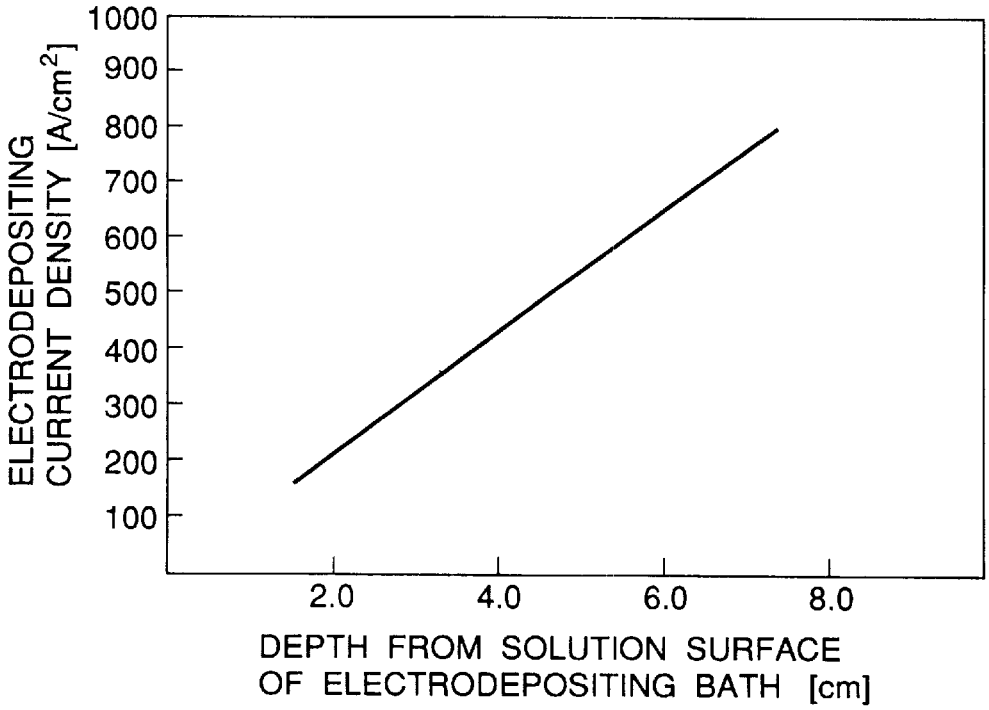

Heaters 910 and 913 were disposed around an electrodeposition vessel. The heater 913 was arranged so that the density of heater elements becomes progressively lower in the direction toward the bottom of the bath. FIG. 8A shows a temperature distribution in the direction of depth in the electrodeposition bath. As seen from FIG. 8A, the electrodepositing bath temperature decreases with increasing the depth from the solution surface of the bath. On the other hand, FIG. 8B shows changes in electrodeposition current. As seen from FIG. 8B, the electrodeposition current increases with increasing the depth from the solution surface of the bath. Heaters 914, 915 and 916 disposed on counter electrodes 911 and 912 were arranged so that the number of heater elements decreased in these heaters in the direction of conveying the conductive base member 904. This arrangement was intended to gradually reduce electrodepositing bath temperature in the direction of conveying the base member 904. The temperature of the electrodepositing bath was 93° C. in the initial stage of electrodeposition and 80° C. at the final of electrodeposition. After the base member passed through the electrodepositing bath, a zinc oxide film of 1.2 $\mu$m thick was found to be deposited on the base member.

When the peeling test was performed on the zinc oxide film thus formed, the film was found to be hard to peel off, that is, found to be reliable. This indicates that the zinc oxide film formed according to the present invention is excellent.

The methods according to claims 1, 2, 3, and 5 have advantages in lower material and running costs and in use of simpler apparatuses, compared with the sputtering method. Moreover, photovoltaic elements produced by the present methods exhibit a large short circuit current density.

The present invention according to claim 4 makes it possible to relatively significantly change the electrodepositing bath temperature characteristics of each of electrodeposition vessels. Therefore, a zinc oxide film can be formed at a high speed, and the adhesive property of a zinc oxide film can be increased. In addition, the shape of irregularities on a zinc oxide film can be controlled, so that a zinc oxide film having a highly light containment effect can be formed. By producing a photovoltaic element using the present production method, it is possible to increase productivity, photoelectric conversion efficiency, and reliability.

The present invention according to claim 6 makes it possible to slope a distribution of temperature of an electrodepositing bath and stir the bath in a predetermined direction, whereby it is possible to form a uniform zinc oxide film having few abnormal growths. By using this zinc oxide film in a photovoltaic element, it is possible to improve the reliability of a photovoltaic element.

The present invention according to claims 7, 8 and 10 make it possible to reduce the number of abnormal growths on a zinc oxide film. By using this zinc oxide film with a reduced number of abnormal growths in a photovoltaic element, it is possible to increase the reliability of a photovoltaic element.

The present invention according to claim 9 makes it possible to reduce the burnout voltage during electrodeposition, thereby remarkably preventing abnormal growths on a zinc oxide film. By using this zinc oxide film with a reduced number of abnormal growths in a photovoltaic element, it is possible to increase the reliability of a photovoltaic element.

The present invention according to claim 11 can make a zinc oxide film more uniform. By using this zinc oxide film having uniformity in a photovoltaic element, it is possible to increase the reliability and good product yield of a photovoltaic element.

What is claimed is:

1. A method of producing a zinc oxide film, which comprises applying current between a conductive base member immersed in a single electrodepositing bath and a counter electrode immersed in the electrodepositing bath to form a zinc oxide film on the conductive base member, wherein the electrodepositing bath is maintained at a temperature of 50° C. or more and has a temperature profile such that a temperature of the electrodepositing bath is lower in a final stage of electrodepositing a layer of the zinc oxide film than in an initial stage of electrodepositing the layer of the zinc oxide film.

2. A method of producing a zinc oxide film according to claim 1, wherein the counter electrode is made of zinc.

3. A method of producing a zinc oxide film according to claim 1, wherein the conductive base member is continuously conveyed into the electrodepositing bath.

4. A method of producing a zinc oxide film according to claim 1, wherein the electrodepositing bath is an aqueous solution-containing at least nitrate ions, zinc ions, and carbohydrates.

5. A method of producing a zinc oxide film according to claim 1, wherein the electrodepositing bath is circulated and heated and then returned to an electrodepositing vessel.

6. A method of producing a zinc oxide film according to claim 1, wherein the conductive base member is heated and annealed immediately before or after immersed in the electrodepositing bath.

7. A method of producing a zinc oxide film according to claim 1, wherein a heated electrodepositing bath is added to the electrodepositing bath.

8. A method of producing a zinc oxide film according to claim 1, wherein a pressure of an atmosphere in contact with the electrodepositing bath is set to above atmospheric pressure.

9. A method of producing a zinc oxide film according to claim 1, wherein the counter electrode is heated.

10. A method of producing a zinc oxide film according to claim 1, wherein a temperature correcting value of the electrodepositing bath is calculated from the temperature of the electrodepositing bath, a width and a thickness of the conductive base member, and a conveying speed of the conductive base member, and the temperature of the electrodepositing bath is controlled by a temperature controller on a basis of the temperature correcting value.

11. A method of producing a photovoltaic element, which comprises the steps of: forming a zinc oxide film on a conductive base member by applying current between the conductive base member immersed in a single electrodepositing bath and a counter electrode immersed in the electrodepositing bath; and forming a semiconductor layer, wherein the electrodepositing bath is maintained at a temperature of 50° C. or more and has a temperature profile such that a temperature of the electrodepositing bath is lower in a final stage of electrodepositing a layer of the zinc oxide film than in an initial stage of electrodepositing the layer of the zinc oxide film.

12. A method of producing a photovoltaic element according to claim 11, wherein the counter electrode is made of zinc.

13. A method of producing a photovoltaic element according to claim 11, wherein the conductive base member is continuously conveyed into the electrodepositing bath.

14. A method of producing a photovoltaic element according to claim 11, wherein the electrodepositing bath is an aqueous solution containing at least nitrate ions, zinc ions, and carbohydrates.

15. A method of producing a photovoltaic element according to claim 11, wherein the electrodepositing bath is circulated and heated and then returned to an electrodepositing vessel.

16. A method of producing a photovoltaic element according to claim 11, wherein the conductive base member is heated and annealed immediately before or after immersed in the electrodepositing bath.

17. A method of producing a photovoltaic element according to claim 11, wherein a heated electrodepositing bath is added to the electrodepositing bath.

18. A method of producing a photovoltaic element according to claim 11, wherein a pressure of an atmosphere in contact with the electrodepositing bath is set to above atmospheric pressure.

19. A method of producing a photovoltaic element according to claim 11, wherein the counter electrode is heated.

20. A method of producing a photovoltaic element according to claim 11, wherein a temperature correcting value of the electrodepositing bath is calculated from the temperature of the electrodepositing bath, a width and a thickness of the conductive base member, and a conveying speed of the conductive base member, and the temperature of the electrodepositing bath is controlled by a temperature controller on a basis of the temperature correcting value.

21. A method of producing a semiconductor element substrate, which comprises applying current between a conductive base member immersed in a single electrodepositing bath and a counter electrode immersed in the electrodepositing bath to form a zinc oxide film on the conductive base member, wherein the electrodepositing bath is maintained at a temperature of 50° C. or more and has a temperature profile such that a temperature of the electrodepositing bath is lower in a final stage of electrodepositing a layer of the zinc oxide film than in an initial stage of electrodepositing the layer of the zinc oxide film.

22. A method of producing a semiconductor element substrate according to claim 21, wherein the counter electrode is made of zinc.

23. A method of producing a semiconductor element substrate according to claim 21, wherein the conductive base member is continuously conveyed into the electrodepositing bath.

24. A method of producing a semiconductor element substrate according to claim 21, wherein the electrodepositing bath is an aqueous solution containing at least nitrate ions, zinc ions, and carbohydrates.

25. A method of producing a semiconductor element substrate according to claim 21, wherein the electrodepositing bath is circulated and heated and then returned to an electrodepositing vessel.

26. A method of producing a semiconductor element substrate according to claim 21, wherein the conductive base member is annealed immediately before or after immersed in the electrodepositing bath.

27. A method of producing a semiconductor element substrate according to claim 21, wherein a heated electrodepositing bath is added to the electrodepositing bath.

28. A method of producing a semiconductor element substrate according to claim 21, wherein a pressure of an atmosphere in contact with the electrodepositing bath is set to above atmospheric pressure.

29. A method of producing a semiconductor element substrate according to claim 21, wherein the counter electrode is heated.

30. A method of producing a semiconductor element substrate according to claim 21, wherein a temperature correcting value of the electrodepositing bath is calculated from the temperature of the electrodepositing bath, a width and a thickness of the conductive base member, and a conveying speed of the conductive base member, and the temperature of the electrodepositing bath is controlled by a temperature controller on a basis of the temperature correcting value.

31. A method of producing a zinc oxide film, which comprises applying current between a conductive base member immersed in a single electrodepositing bath and a counter electrode immersed in the electrodepositing bath to form a zinc oxide film on the conductive base member, wherein the electrodepositing bath is maintained at a temperature of 50° C. or more and has a temperature profile such that a temperature of the electrodepositing bath is lower in a final stage of electrodepositing a layer of the zinc oxide film than in an initial stage of electrodepositing the layer of the zinc oxide film, said temperature of the electrodepositing bath being lowered between the initial and the final stage while the current is applied.

32. A method of producing a photovoltaic element, which comprises the steps of: forming a zinc oxide film on a conductive base member by applying current between the conductive base member immersed in a single electrodepositing bath and a counter electrode immersed in the electrodepositing bath; and forming a semiconductor layer, wherein the electrodepositing bath is maintained at a temperature of 50° C. or more and has a temperature profile such that a temperature of the electrodepositing bath is lower in a final stage of electrodepositing a layer of the zinc oxide film than in an initial stage of electrodepositing the layer of the zinc oxide film, said temperature of the electrodepositing bath being lowered between the initial stage and the final stage while the current is applied.

33. A method of producing a semiconductor element substrate, which comprises applying current between a conductive base member immersed in a single electrodepositing bath and a counter electrode immersed in the electrodepositing bath to form a zinc oxide film on the conductive base member, wherein the electrodepositing bath is maintained at a temperature of 50° C. or more and has a temperature profile such that a temperature of the electrodepositing bath is lower in a final stage of electrodepositing a layer of the zinc oxide film than in an initial stage of electrodepositing the layer of the zinc oxide film, said temperature of the electrodepositing bath being lowered between the initial stage and the final stage while the current is applied.

* * * * *

UNITED STATES PATENT AND TRADEMARK OFFICE

CERTIFICATE OF CORRECTION

PATENT NO. : 6,379,521 B1
DATED : April 30, 2002
INVENTOR(S) : Yutaka Nishio

It is certified that error appears in the above-identified patent and that said Letters Patent is hereby corrected as shown below:

Title page,
Item [57], ABSTRACT,
Line 10, "initial" should read -- initial stage --; and
Line 13, "low a" should read -- a low --.

Column 6,
Line 38, "steal" should read -- steel --; and
Line 44, "speed" should read -- speeds --.

Column 7,
Line 16, "flew" should read -- flowed --; and
Line 56, "completely polycrystalline" should read -- complete polycrystallinity --.

Column 8,
Line 10, "becomes" should read -- become --;
Line 16, "energy and" should read -- energy, which --; and
Line 45, "is" should read -- are --.

Column 10,
Line 10, "many" should read -- by --;
Line 11, "a" should read -- on a --; and
Line 58, "profile the" should read -- profile; the --.

Column 11,
Line 21, "used an apparatus" should read -- an apparatus is used --;
Line 27, "As" should be deleted;
Line 57, "radiator, means" should read -- radiator and a --; and
Line 67, "its" should read -- their --.

Column 12,
Line 18, "denote" should read -- denotes --;
Line 24, "as" should be deleted;
Line 32, "may" should read -- may be --; and
Line 36, "blow." should read -- below. --.

UNITED STATES PATENT AND TRADEMARK OFFICE

CERTIFICATE OF CORRECTION

PATENT NO. : 6,379,521 B1
DATED : April 30, 2002
INVENTOR(S) : Yutaka Nishio

It is certified that error appears in the above-identified patent and that said Letters Patent is hereby corrected as shown below:

Column 13,
Line 26, "executed" should read -- be executed --.

Column 15,
Line 51, "An" should read -- ¶ An --.

Column 16,
Line 67, "german" should read -- germane --.

Column 17,
Line 25, "an" should read -- a --; and
Line 36, "electrodes" should read -- electrode --.

Column 18,
Line 15, "german" should read -- germane --.

Column 19,
Line 17, "an" should read -- a --;
Line 37, "eters" should read -- eter --; and
Line 48, "a fewer abnormal growth" should read -- fewer abnormal growths --.

Column 20,
Line 1, "heater" should read -- heaters --;
Line 40, "according to claim 4" should be deleted;
Line 47, "highly" should read -- high --;
Line 51, "claim 6" should read -- claim 5 --;
Line 59, "claims 7, 8 and 10" should read -- claims 6, 7 and 9 --; and
Line 65, "claim 9" should read -- claim 8 --.

UNITED STATES PATENT AND TRADEMARK OFFICE

CERTIFICATE OF CORRECTION

PATENT NO. : 6,379,521 B1
DATED : April 30, 2002
INVENTOR(S) : Yutaka Nishio

It is certified that error appears in the above-identified patent and that said Letters Patent is hereby corrected as shown below:

Column 21,
Line 4, "claim 11" should read -- claim 10 --;
Line 27, "solution-containing" should read -- solution containing --; and
Line 34, "immersed" should read -- being immersed --.

Column 22,
Lines 14 and 61, "immersed" should read -- being immersed --.

Signed and Sealed this

Twenty-second Day of July, 2003

JAMES E. ROGAN
*Director of the United States Patent and Trademark Office*